US005300993A

United States Patent [19]

Vetromile

[11] Patent Number: 5,300,993

[45] Date of Patent: Apr. 5, 1994

[54] TRANSFER ASSIST APPARATUS

[75] Inventor: Joseph S. Vetromile, Rochester, N.Y.

[73] Assignee: Xerox Corporation, Stamford, Conn.

[21] Appl. No.: 55,046

[22] Filed: Apr. 29, 1993

[51] Int. Cl.[5] ..... G03G 15/16

[52] U.S. Cl. ..... 355/271; 355/309

[58] Field of Search ..... 355/308, 309, 273, 271, 355/274, 212

[56] References Cited

U.S. PATENT DOCUMENTS 4,541,709 9/1985 Kampschreur ..... 355/3 TR
4,931,839 6/1990 Tompkins ..... 355/271 X
4,947,214 8/1990 Baxendell et al. ..... 355/274

*Primary Examiner*—R. L. Moses

*Attorney, Agent, or Firm*—Denis A. Robitaille

[57] ABSTRACT

An apparatus which transfers a developed image from a photoconductive surface to a copy sheet. The apparatus includes a corona generating device arranged to charge the copy sheet for establishing a transfer field that is effective to attract the developed image from the photoconductive surface to the copy sheet and a blade which is moved from a non-operative position spaced from the copy sheet, to an operative position, in contact therewith. The blade presses the copy sheet into contact with at least the developed image on the photoconductive surface to substantially eliminate any spaces between the copy sheet and the developed image during transfer of the developed image from the photoconductive surface to the copy sheet.

20 Claims, 6 Drawing Sheets

TRANSFER ASSIST APPARATUS

The present invention relates generally to an electrophotographic printing machine, and more specifically concerns an apparatus for assisting the transfer of a developed image from a photoconductive imaging surface to a copy sheet.

In a typical electrophotographic copying process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate.

The electrophotographic printing process described above is well known and is commonly used for light lens copying of an original document. Analogous processes also exist in other electrostatographic printing applications such as, for example, digital printing where the latent image is produce by a modulated laser beam, or ionographic printing and reproduction, where charge is deposited on a charge retentive surface in response to electronically generated or stored images.

The process of transferring charged toner particles from an image bearing member such as the photoconductive member to an image support substrate such as the copy sheet is is enabled by overcoming adhesive forces holding the toner particles to the image bearing member. In general, transfer of developed toner images in electrostatographic applications has been accomplished via electrostatic induction using a corona generating device, wherein the image support substrate is placed in direct contact with the developed toner image on the photoconductive surface while the reverse side of the image support substrate is exposed to a corona discharge. This corona discharge generates ions having a polarity opposite that of the toner particles, thereby electrostatically attracting and transferring the toner particles from the photoreceptive member to the image support substrate. An exemplary corotron ion emission transfer system is disclosed in U.S. Pat. No. 2,836,725.

In the electrostatic transfer of the toner powder image to the copy sheet, it is necessary for the copy sheet to be in uniform intimate contact with the toner powder image developed on the photoconductive surface. Unfortunately, the interface between the photoreceptive surface and the copy substrate is not always optimal. In particular, non-flat or uneven image support substrates, such as copy sheets that have been mishandled, left exposed to the environment or previously passed through a fixing operation (e.g., heat and/or pressure fusing) tend to promulgate imperfect contact with the photoreceptive surface of the photoconductor. Further, in the event the copy sheet is wrinkled, the sheet will not be in intimate contact with the photoconductive surface and spaces or air gaps will materialize between the developed image on the photoconductive surface and the copy sheet. Problems may occur in the transfer process when spaces or gaps exist between the developed image and the copy substrate. There is a tendency for toner not to transfer across these gaps, causing variable transfer efficiency and, in the extreme, can create areas of low or no transfer resulting in a phenomenon known as image transfer deletion. Clearly, an image deletion is very undesirable in that useful information and indicia are not reproduced on the copy sheet.

As described, the typical process of transferring development materials in an electrostatographic system involves the physical detachment and transfer-over of charged toner particles from an image bearing photoreceptive surface into attachment with an image support substrate via electrostatic force fields. Thus, a very critical aspect of the transfer process is focused on the application and maintenance of high intensity electrostatic fields in the transfer region for overcoming the adhesive forces acting on the toner particles as they rest on the photoreceptive member. In addition, other forces, such as mechanical pressure or vibratory energy, have been used to support and enhance the transfer process. Careful control of these electrostatic fields and other forces is required to induce the physical detachment and transfer-over of the charged toner particles without scattering or smearing of the developer material.

The problem of transfer deletion has been addressed through various approaches. For example, an acoustic agitation system incorporating a resonator suitable for generating vibratory energy arranged in line with the back side of the photoconductor to apply uniform vibratory energy thereto has been disclosed in commonly assigned U.S. Pat. No. 5,081,500 as a method for enhancing toner release from the photoreceptive surface. In accordance with the concept of that patent, toner can be released from the image bearing surface of the photoconductor despite the fact that electrostatic charges in the transfer zone may be insufficient to attract toner over to the image support substrate.

Alternatively, mechanical devices, such as rollers, have been used to force the image support substrate into intimate and substantially uniform contact with the image bearing surface. For example, in the series 9000 family of electrophotographic printing machines manufactured by the Xerox Corporation, an electrically biased transfer roll system is effective in substantially eliminating image deletions. In other electrophotographic printing machines, such as the Model No. 1065 manufactured by the Xerox Corporation, the copy sheet is provided with a precisely controlled curvature as it enters the transfer station for providing enhanced contact pressure. These and other types of devices illustrating the background of this technology are discussed in U.S. Pat. No. 4,947,214.

An alternative approach to transfer deletion problems has been implemented in the Xerox Corporation Model No. 5090 in which a flexible blade member is allowed to press against the copy sheet by means of a solenoid actuating device. This general approach has also been utilized wherein various contact blade arrangements and actuating devices have been proposed for sweeping over the back side of the image support substrate at the entrance to the transfer region. The present invention is directed toward such as approach wherein a transfer assist blade is deflected against a copy sheet by means of a rotatable member driven by a stepper motor. The following disclosures may be relevant to various aspects of the present invention:

U.S. Pat. No. 4,949,214; Patentee: Baxendell, et al.; issued: Aug. 7, 1990.

U.S. patent application Ser. No. 07/755,412; Inventors: R. Smith et al.; Filed: Sep. 5, 1991.

U.S. patent application Ser. No. 07/933,639; Inventors: R. Smith et al.; Filed: Aug. 24, 1992.

Commonly Assigned U.S. patent application Ser. No. 08/055,048; Inventors: Gross et al.; Filed: Apr. 29, 1993.

The relevant portions of the foregoing disclosures may be briefly summarized as follows:

U.S. Pat. No. 4,947,214 to Baxendell et al. discloses a system for transferring a developed image from a photoconductive surface to a copy sheet, including a corona generating device and a transfer assist blade. The blade is shifted via a solenoid-activated lever arm from a non-operative position spaced from the copy sheet, to an operative position, in contact with the copy sheet for pressing the copy sheet into contact with the developed image on the photoconductive surface to substantially eliminate any spaces therebetween during the transfer process. Although a practical implementation of that patent has been utilized with relative success in the Xerox Corporation model 5090 Duplicator, the embodiment disclosed therein provides selective switching of the transfer assist blade between its operative and non-operative positions by means of a solenoid device. It has been found that the use of such solenoids is unsuitable for high speed copy environments due to speed limitations as well as switching variability associated with commercially available solenoid devices. More specifically, the solenoids used in the implementation of the Baxendell et al. patent in the model 5090 machine, namely solenoid model no. 121E4082, available from Ledex, Inc., of Vandalia, Ohio, are pushed to their maximum speed limitation when creating copies at the designated maximum copy output of 135 copies per minute. Moreover, the time variations in switching introduced by heat, fatigue and other environmental stresses require the use of complex timing algorithms and closed loop control systems. As copy output speeds are pushed to higher limits, the use of solenoids to implement proper switching has become unacceptable.

U.S. patent application Ser. No. 07/755,412 discloses an apparatus for enhancing contact between a copy sheet and a developed image positioned on a photoconductive member which includes a contact member being spaced apart from the copy sheet in a first mode of operation and being in contact with the copy sheet in a second mode of operation. The apparatus of that invention includes a cam movable between a first position and a second position as well as a mechanism for moving the cam between its first position and its second position for positioning the contact member in its first mode of operation in response to the cam being moved to its first position and in its second mode of operation in response to the cam being moved to its second position.

U.S. patent application Ser. No. 07/933,639 discloses a transfer blade for ironing a sheet against a photoreceptor belt during transfer, thereby smoothing out deformities which cause deletions. The transfer blade of that patent application includes a flexible tip to absorb the impact of the blade as it contacts the paper and a spring load to limit and control the force applied to the sheet. Sensors are also utilized to monitor and adjust the timing of the transfer blade. The beam strength of a given copy sheet is a function of the weight thereof such that heavier weight copy sheets have greater beam strength than lighter weight copy sheets. Inasmuch as the sheet conveying system of the printing machine handles a wide range of differing weight copy sheets, it is not unusual for the copy sheet to be wrinkled before it is transported to the processing station where the developed image is transferred to the copy sheet. The stack of copy sheets placed in the sheet feeder may be initially wrinkled, or the copy sheets may become wrinkled as they are fed from the stack to the transfer station.

Copending U.S. application Ser. No. 08/055,048, entitled TRANSFER SYSTEM INCLUDING A CAM ACTUATED SEGMENTED FLEXIBLE TRANSFER ASSIST BLADE filed Apr. 2, 1993 and assigned to common assignee, discloses an apparatus for providing substantially uniform contact between a copy substrate and a developed image located on an imaging member. The structure of that invention comprises contact means, adapted to move from a non-operative position spaced from the imaging member to an operative position in contact with the copy substrate on the imaging member, for applying pressure against the copy substrate in a direction toward the imaging member, and means, including an elevated deflecting surface, for applying a load to the contact means to deflect the contact means into the operative position. The entire disclosure of this application is incorporated by reference herein.

In accordance with the present invention, there is provided an apparatus for providing substantially uniform contact between a copy sheet and a developed image situated on an imaging surface, comprising contact means, adapted to be shifted from a non-operative position spaced from the imaging surface, to an operative position in contact with the copy sheet on the imaging surface, for pressing the copy sheet against the imaging surface. The invention also includes a lever member, pivotable about a pivot point, for shifting the contact means between the non-operative position and the operative position, and rotatable means for selectively pivoting the lever member about the pivot point to effect the shifting of the contact means between the non-operative position and the operative position.

Pursuant to another aspect of the present invention, there is provided an electrophotographic printing machine including a transfer station for transferring a developed image from a moving imaging member to a moving copy substrate, including an apparatus for providing substantially uniform intimate contact between the copy substrate and the developed image located on the imaging member. The invention comprises: contact means, adapted to be shifted from a non-operative position spaced from the imaging surface, to an operative position in contact with the copy substrate on the imaging member, for pressing the copy substrate against the imaging member; a lever member; pivotable about a pivot point, for shifting the contact means between the non-operative position and the operative position; and rotatable means for selectively pivoting the lever member about the pivot point to effect the shifting of the contact means between the non-operative position and the operative position.

The present invention is also directed to an apparatus for providing substantially uniform contact between a copy sheet and a developed image situated on an imaging surface including contact means, adapted to be shifted from a non-operative position spaced from the imaging surface, to an operative position in contact with the copy sheet on the imaging surface, for pressing the copy sheet against the imaging surface and means for selectively shifting said contact means between the non-operative position and the operative position within 40 milliseconds or less.

In yet another aspect of the invention an electrostatographic printing machine including a transfer station for transferring a developed image from a moving imaging member to a moving copy substrate is provided, including an apparatus for providing substantially uniform intimate contact between the copy substrate and the developed image located on the imaging member, comprising contact means, adapted to be shifted from a non-operative position spaced from the imaging surface, to an operative position in contact with the copy substrate on the imaging member, for pressing the copy substrate against the imaging member and means for selectively shifting said contact means between the non-operative position and the operative position within 40 milliseconds or less.

Other aspects of the present invention will become apparent as the following description proceeds and upon reference to the drawings, in which.

Figure 3:
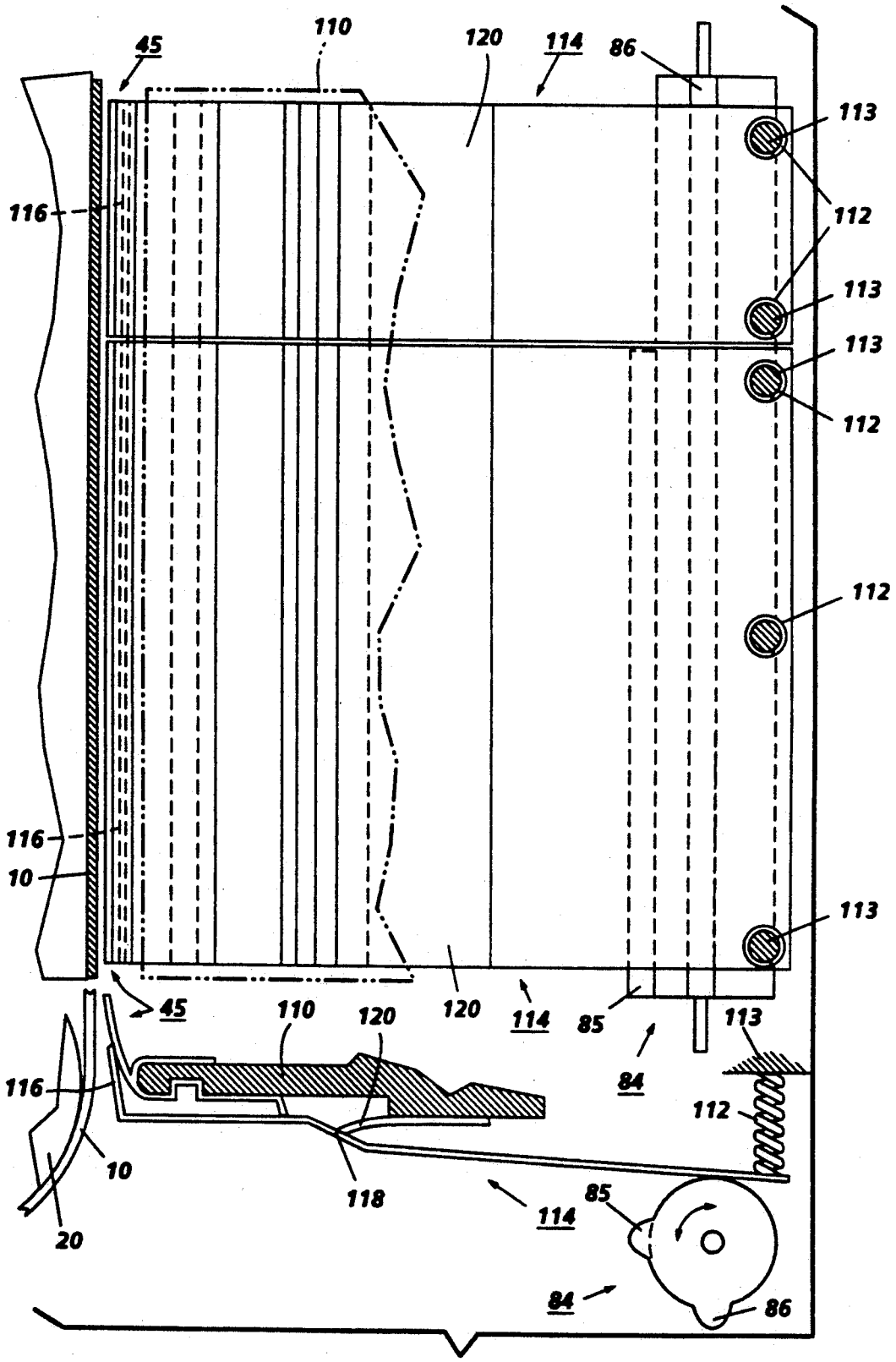
FIG. 3 is a combination elevated view and plan view showing a segmented transfer assist blade and segmented lever arm for accomodating copy sheets of various widths with the present invention.
Figure 4:
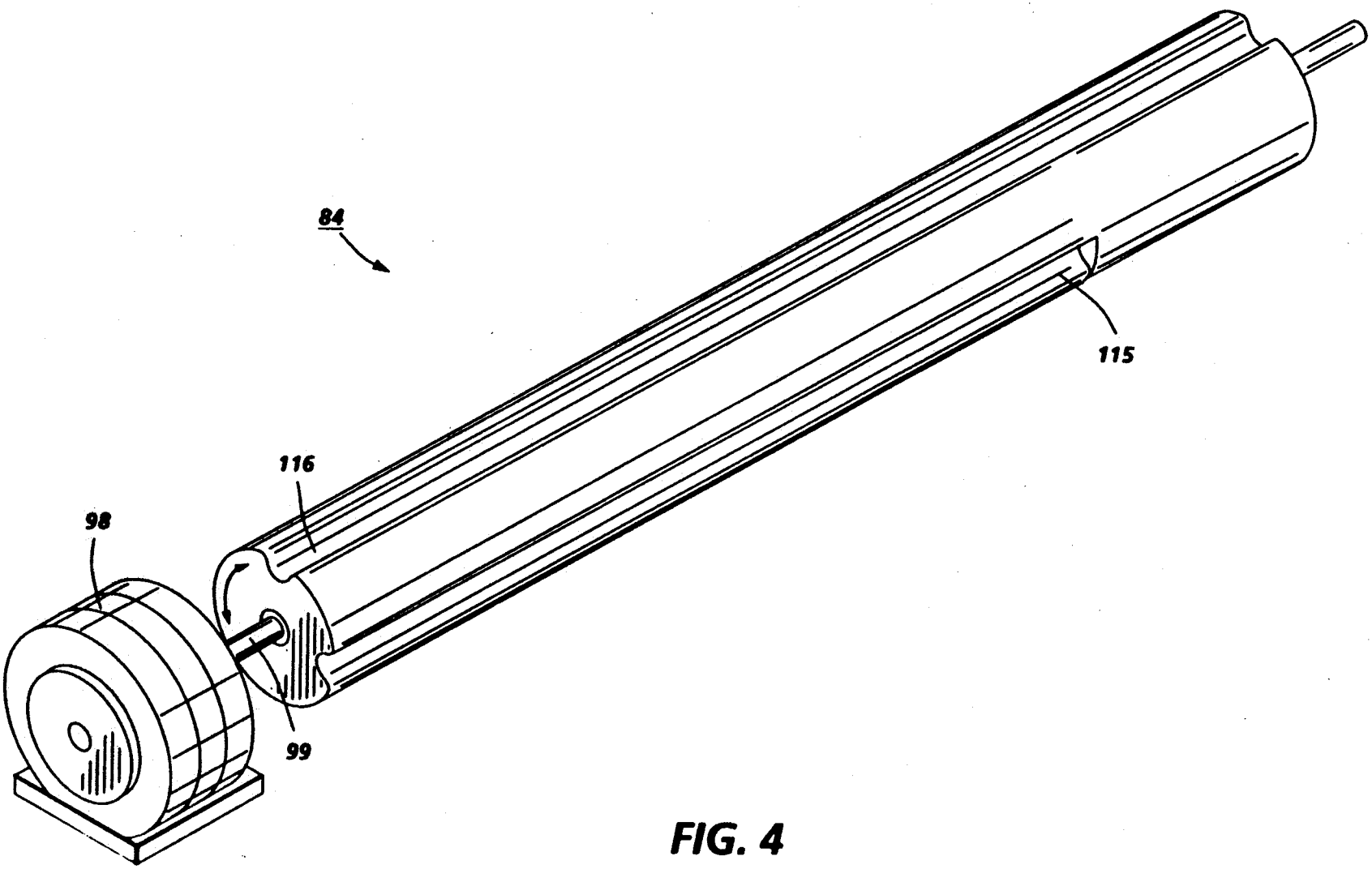
FIG. 4 is an elevational view of an alternative embodiment of the present invention showing the transfer assist blade and the actuation mechanism thereof.
Figure 5:
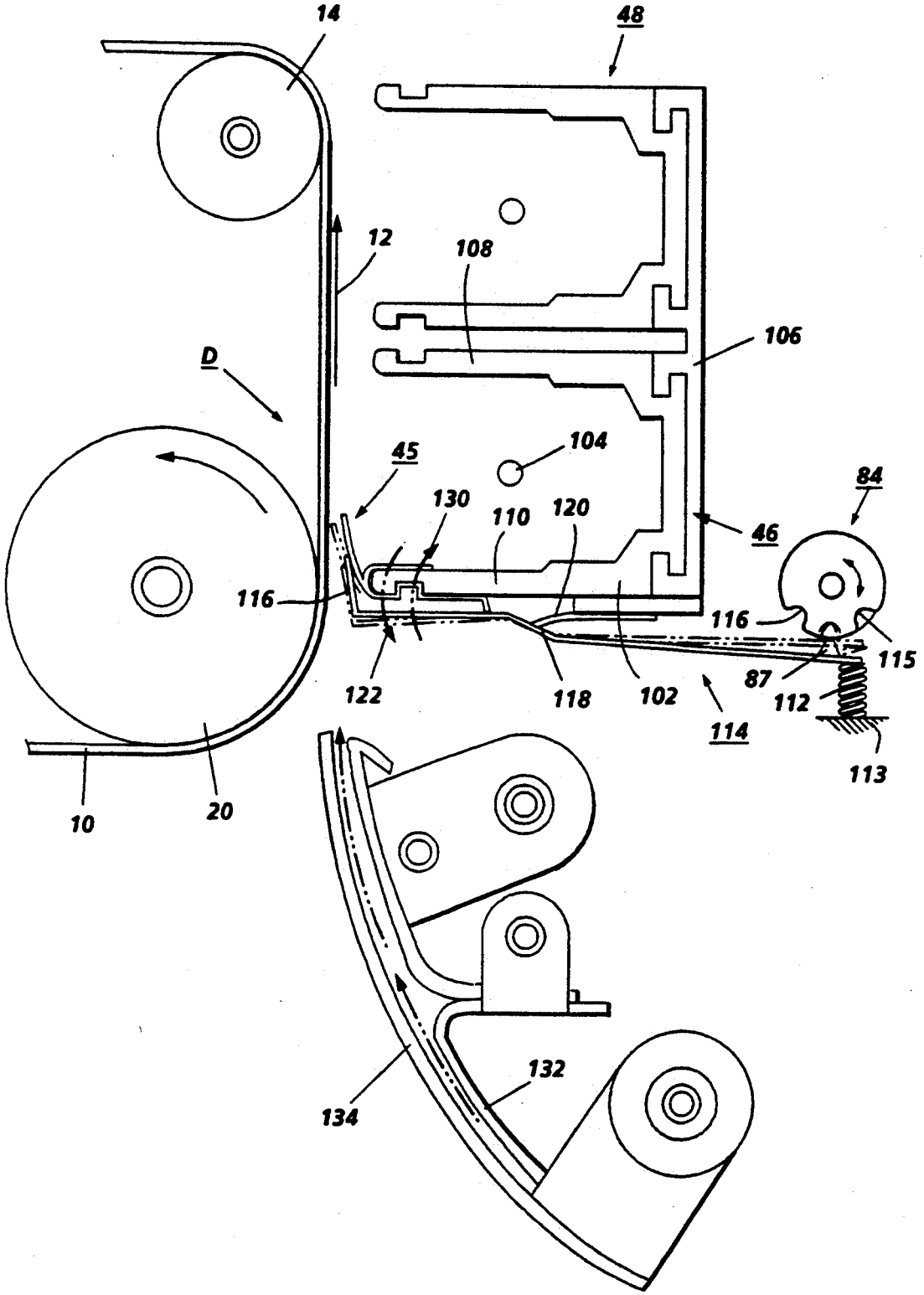
Figure 6:
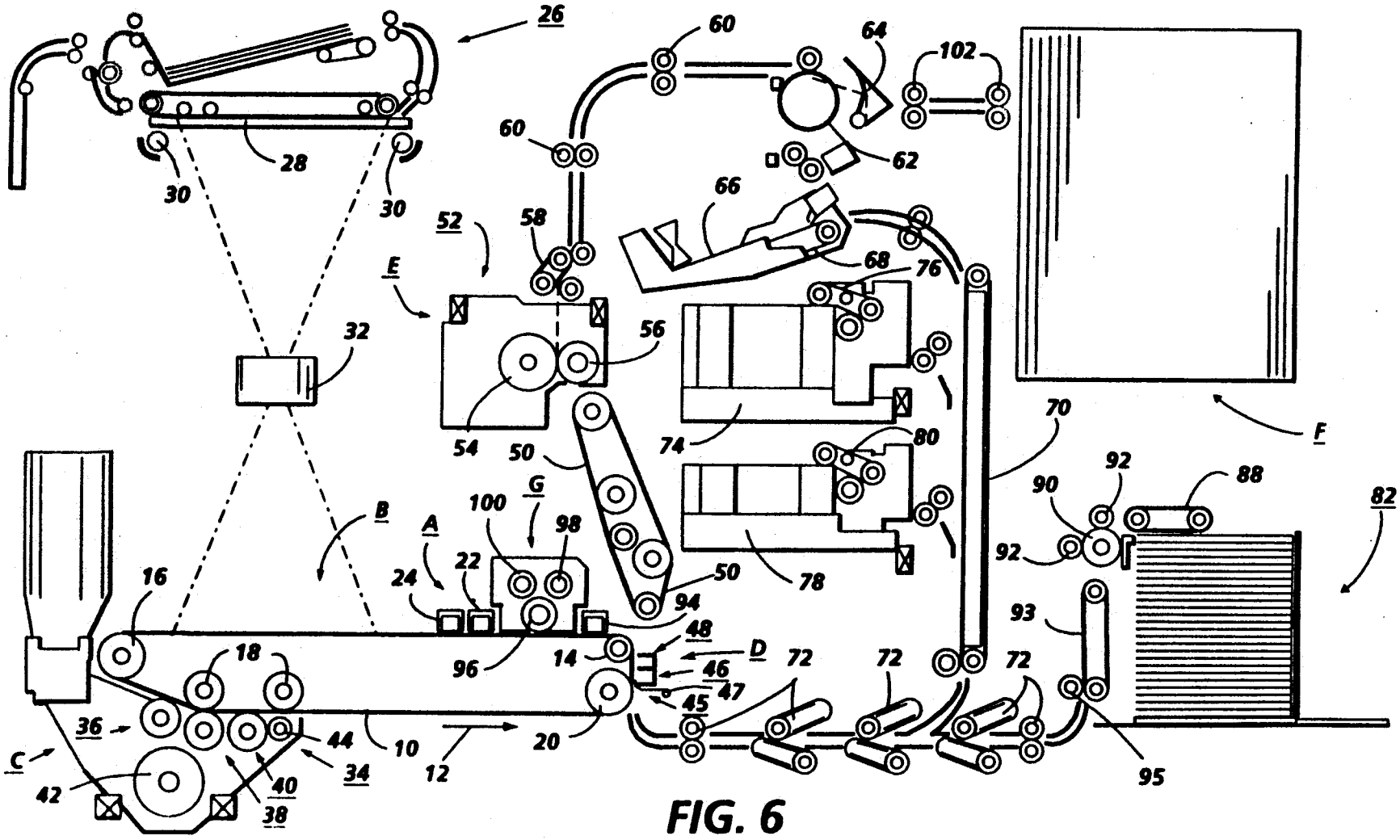

FIG. 5 is a perspective view of the rotational member used for actuation of the transfer assist blade in the embodiment of FIG. 3; and FIG. 6 is a schematic elevational view depicting an illustrative electrophotographic printing machine incorporating the apparatus of the present invention therein While the present invention will hereinafter be described in connection with a preferred embodiment and method of use, it will be understood that it is not intended to limit the invention to that embodiment or method of use. On the contrary, the following description is intended to cover all alternatives, modifications, and equivalents, as may be included within the spirit and scope of the invention as defined by the appended claims. Other aspects and features of the present invention will become apparent as the following description progresses.

For a general understanding of the features of the present invention, reference is made to the drawings, wherein like reference numerals have been used throughout to identify identical or similar elements. Turning initially to FIG. 6 prior to discussing the invention in detail, a schematic depiction of an exemplary electrophotographic reproducing machine incorporating various machine components is furnished in order to provide a general background and understanding of the features of the present invention. Although the apparatus of the present invention is particularly well adapted for use in an automatic electrophotographic reproducing machine as shown in FIG. 6, it will become apparent from the following discussion that the transfer assist blade and actuating apparatus of the present invention is equally well suited for use in a wide variety of electrostatographic processing machines as well as many other known printing systems. It will be further understood that the present invention is not necessarily limited in its application to the particular embodiment or embodiments shown and described herein.

The exemplary electrophotographic printing machine of FIG. 6 employs a photoconductive belt 10, preferably comprising a photoconductive material coated on a ground layer, which, in turn, is coated on an anti-curl substrate. The photoconductive material includes a transport layer, which typically contains small molecules of di-m-tolydiphenylbiphenyldiamine dispersed in a polycarbonate, coated on a generator layer, generally made from trigonal selenium while the grounding layer is made from a titanium coated Mylar. Of course, other suitable photoconductive materials, ground layers, and anti-curl substrates may also be employed. Belt 10 is entrained about stripping roller 14, tensioning roller 16, roller 18, and drive roller 20. Stripping roller 14 and rollers 18 are mounted rotatably so as to rotate with belt 10. Tensioning roller 16 is resiliently urged against belt 10 to maintain belt 10 under a desired tension. Drive roller 20 is rotated by a motor (not shown) coupled thereto by any suitable means such as a drive belt. Thus, as roller 20 rotates, it advances belt 10 in the direction of arrow 12 to advance successive portions of the photoconductive surface sequentially through the various processing stations disposed about the path of movement thereof.

Initially, a portion of photoconductive belt 10 passes through charging station A whereat two corona generating devices, indicated generally by the reference numerals 22 and 24 charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas missed by corona generating device 22.

Next, the charged portion of photoconductive belt 10 is advanced through imaging station B. At imaging station B, a document handling unit, indicated generally by reference numeral 26, is positioned over platen 28 of the printing machine. The document handling unit 26 sequentially feeds documents from a stack of documents placed in a document stacking and holding tray such that the original documents to be copied are loaded face up into the document tray on top of the document handling unit. Using this system, a document feeder, located below the tray, feeds the bottom document in the stack to rollers for advancing the document onto platen 28 by means of a belt transport which is lowered onto the platen with the original document being interposed between the platen and the belt transport. When the original document is properly positioned on platen 28, the document is images and the original document is returned to the document tray from platen 28 by either of two paths. If a simplex copy is being made or if this is the first pass of a duplex copy, the original document is returned to the document tray via a simplex path. If this is the inversion pass of a duplex copy, then the original document is returned to the document tray through a duplex path. Imaging of the document is achieved by two flash lamps 30 mounted in the optics cavity for illuminating the document on platen 28. Light rays reflected from the document are transmitted through lens 32 which focuses the light image of the original document onto the charge portion of the photoconductive surface of belt 10 to selectively dissipate the charge thereon. This records an electrostatic latent image on photoconductive belt 10 corresponding to the informational areas contained within the original document. Thereafter, photoconductive belt 10 advances the electrostatic latent image recorded thereon to development station C.

At development station C, a magnetic brush developer housing, indicated generally by the reference numeral 34, is provided, having three developer rolls, indicated generally by the reference numerals 36, 38 and 40. A paddle wheel 42 picks up developer material in the developer housing and delivers it to the developer rolls. When the developer material reaches rolls 36 and 38, it is magnetically split between the rolls with approximately half of the developer material being delivered to each roll. Photoconductive belt 10 is partly wrapped about rolls 36 and 38 to form an extended development zones. Developer rolls 40 is a cleanup roll and magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet (not shown) is moved into contact with the toner powder image on belt 10. The developed image on belt 10 contacts the advancing sheet of support material in a timed sequence and is transferred thereon at transfer station D. As can be seen in the illustrated embodiment, a corona generating device 46 charges the copy sheet to a proper potential so that the sheet is electrostatically secured or "tacked" to belt 10 and the toner image thereon is attracted to the copy sheet.

Unfortunately, it is not uncommon for air gaps or spaces to exist between the copy sheet and the surface of the belt 10. For example, some publishing applications require imaging onto high quality papers having surface textures which prevent intimate contact of the paper with the developed toner images. In duplex printing systems, even initially flat paper can become cockled or wrinkled as the result of the first side fusing step. Also, color images can contain areas in which intimate contact of toner with paper during the transfer step is prevented by adjacent areas of high toner pile heights. The lack of uniform intimate contact between the belt and the copy sheet in these situations can inhibit transfer and may result in image deletions, i.e., image areas where transfer has failed to occur. Contact assisted transfer, as provided by the present invention, is a technique that helps reduce the occurrence of such deletions by creating intimate contact between the copy sheet and the photoreceptor belt 10 to eliminate or minimize the forces that retard toner migration toward the copy substrate. In addition, such uniform intimate contact provides increased transfer efficiency with lower than normal transfer fields, which not only yields better copy quality, but also results in improved toner use efficiency as well as a reduced load on the cleaning system.

In accordance with the present invention, the interface between the sheet feeding apparatus and transfer station D includes an apparatus for applying uniform contact pressure to the sheet as it is advanced onto belt 10. The copy sheet is advanced along a sheet path between a pair of baffle members and pressed into contact with the toner powder image on photoconductive surface 12 by a transfer assist blade, indicated generally by the reference numeral 45. A light sensor (not shown) detects the leading edge of the copy sheet as it enters transfer station D and the signal from the light sensor is processed by a circuit for controlling the actuation of blade 45 which is moved from a non-operative position, spaced from the copy sheet and photoconductive belt 10 to an operative position in contact with the backside of the copy sheet. A rotatable member 47 moves blade 45 between the operative and non-operative positions. In the operative position, blade 45 presses the copy sheet into contact with the toner powder image developed on photoconductive belt 10 for substantially eliminating any spaces between the copy sheet and the toner powder image such that the continuous pressing of the sheet into contact with the toner powder image at the transfer station insures that the copy sheet is in substantially intimate contact with the belt 10. Corona generating device 46 charges the copy sheet to the proper magnitude and polarity so that the copy sheet is tacked to photoconductive belt 10 and the toner powder image is attracted from the photoconductive belt to the copy sheet. Thereafter, the copy sheet moves with photoconductive belt 10, in the direction of arrow 12. As the trailing edge of the copy sheet passes the light sensor, the light sensor transmits a signal to a processing circuit which actuates a rotatable member for shifting the blade 45 to its non-operative position. In the non-operative position, blade 45 is spaced from the copy sheet and the photoconductive belt, insuring that blade 45 does not scratch the photoconductive belt or accumulate toner particles thereon which may be deposited on the backside of the next successive copy sheet. An exemplary type of light sensor and delay circuit is described in U.S. Pat. No. 4,341,456 issued to Iyer et al. in 1982, the relevant portions thereof being hereby incorporated into the present application. Further details of this apparatus will be described hereinafter with reference to FIGS. 1–5.

After transfer, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller 56 abuts the fuser roller 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl, as well as any other curls or wrinkles which may have been introduced into the copy sheet. The copy sheet is then advanced, via forwarding roller pairs 60 to duplex turn roll 62. A duplex solenoid gate 64 selectively guides the copy sheet to finishing station F or to duplex tray 66. In the finishing station, the copy sheets are collected in sets and the copy sheets of each set can be stapled or glued together. Alternatively, duplex solenoid gate 64 diverts the sheet into duplex tray 66, providing intermediate storage for those sheets that have been printed on one side and on which an image will be subsequently printed on the second, opposed side thereof, i.e. the sheets being duplexed. The sheets are stacked in duplex tray 66 face down on top of one another in the order in which they are copied. In order to complete duplex copying, the simplex sheets in tray 66 are fed, in seriatim, by a bottom feeder 68 from tray 66 back to transfer station D, via conveyor 70 and rollers 72, for transfer of the toner powder image to the opposed sides of the copy sheets. Once again blade 45 is actuated and moved from the non-operative position to the operative position. After the copy sheet exits the transfer station, blade 45 is actuated once again and returned to the non-operative position. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets may also be fed to transfer station D from a secondary tray 74 which includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by a sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from an auxiliary tray 78. As in the case of the secondary tray 74, the auxiliary tray 78 includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are supplemental sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D.

Invariably, after the copy sheet is separated from photoconductive belt 10, some residual particles remain bonded thereto. After transfer, photoconductive belt 10 passes beneath yet another corona generating device 94 which charges the residual toner particles to the proper polarity for breaking the bond between the toner particles and the belt. Thereafter, a pre-charge erase lamp (not shown), located inside the loop formed by photoconductive belt 10, discharges the photoconductive belt in preparation for the next charging cycle. Residual particles are removed from the photoconductive surface at cleaning station G. Cleaning station G includes an electrically biased cleaner brush 96 and two waste and reclaim de-toning rolls 98 and 100. The reclaim roll 98 is electrically biased negatively relative to the cleaner roll 96 so as to remove toner particles therefrom while the waste roll 100 is electrically biased positively relative to the reclaim roll 98 so as to remove paper debris and wrong sign toner particles. The toner particles on the reclaim roll 98 are scraped off and deposited in a reclaim auger (not shown), where they are transported out of the rear of cleaning station G.

The various machine functions are regulated by a controller (not shown) which is preferably a programmable microprocessor which manages all of the machine functions hereinbefore described. Among other things, the controller provides a comparison count of the copy sheets, the number of documents being recirculated, the number of copy sheets selected by the operator, time delays, jam indications and transfer assist blade actuation. The operation of all of the exemplary systems described hereinabove may be accomplished by conventional user interface control switch inputs from the printing machine consoles selected by the operator. Conventional sheet path sensors or switches may be utilized to keep track of the position of documents and the sheets in the machine. In addition, the controller regulates the various positions of gates and switching depending upon the mode of operation selected.

The foregoing description should be sufficient for the purposes of the present application for patent to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Moving now to FIGS. 1-5, the particular features of the transfer assist apparatus of the present invention, including various embodiments thereof, will be described in greater detail. With specific reference to FIG. 1, the transfer assist apparatus is depicted in an enlarged, elevational view to more clearly reveal the various components included therein. As shown in this Figure, a copy substrate (now shown) is transported between baffle members 132 and 134 toward photoconductive belt 10 at transfer station D. Corona generating device 46, situated at the transfer station, includes a generally U-shaped shield, indicated generally by the reference numeral 102, and an elongated electrode wire 104. Shield 102 has a back wall 106 and a pair of opposed, spaced side walls 108 and 110 secured thereto. One skilled in the art will appreciate that any suitable corona generating device may be employed, as for example, a corona generator having an electrode which is comprised of spaced pins, or a shield which may be limited to a pair of side walls having no back wall. The corona generating device 46 provides a means for charging the copy sheet in the transfer station to attract the toner powder image from the photoconductive belt 10 to the copy sheet.

As previously discussed, the transfer assist assembly of the present invention includes a transfer assist blade 45. In the embodiment depicted herein, blade 45 is fabricated from a thin, flexible sheet material such as Mylar, available from E. I. DuPont de Nemours and Company of Wilmington, Del., or some other polyester sheet material which is elastically deformable to an arcuate shape. The blade 45 is secured to a marginal region of side wall 110. A lever arm 114 having a free end 116, is also attached to side shield member 110 at a pivot point 118. A spring assembly 112 is positioned between the lever arm 114 and a fixed surface 113 at an end of the lever arm opposite the free end 116 for urging the free end 116 of lever arm 114 against blade 45. The lever arm 114 is selectively pivoted about pivot point 118 for permitting free end 116 of lever arm 114 to shift away from blade 45 to allow the blade to move between the non-operative position spaced from the belt 10 to the operative position for pressing a copy sheet against belt 10.

Figure 1:
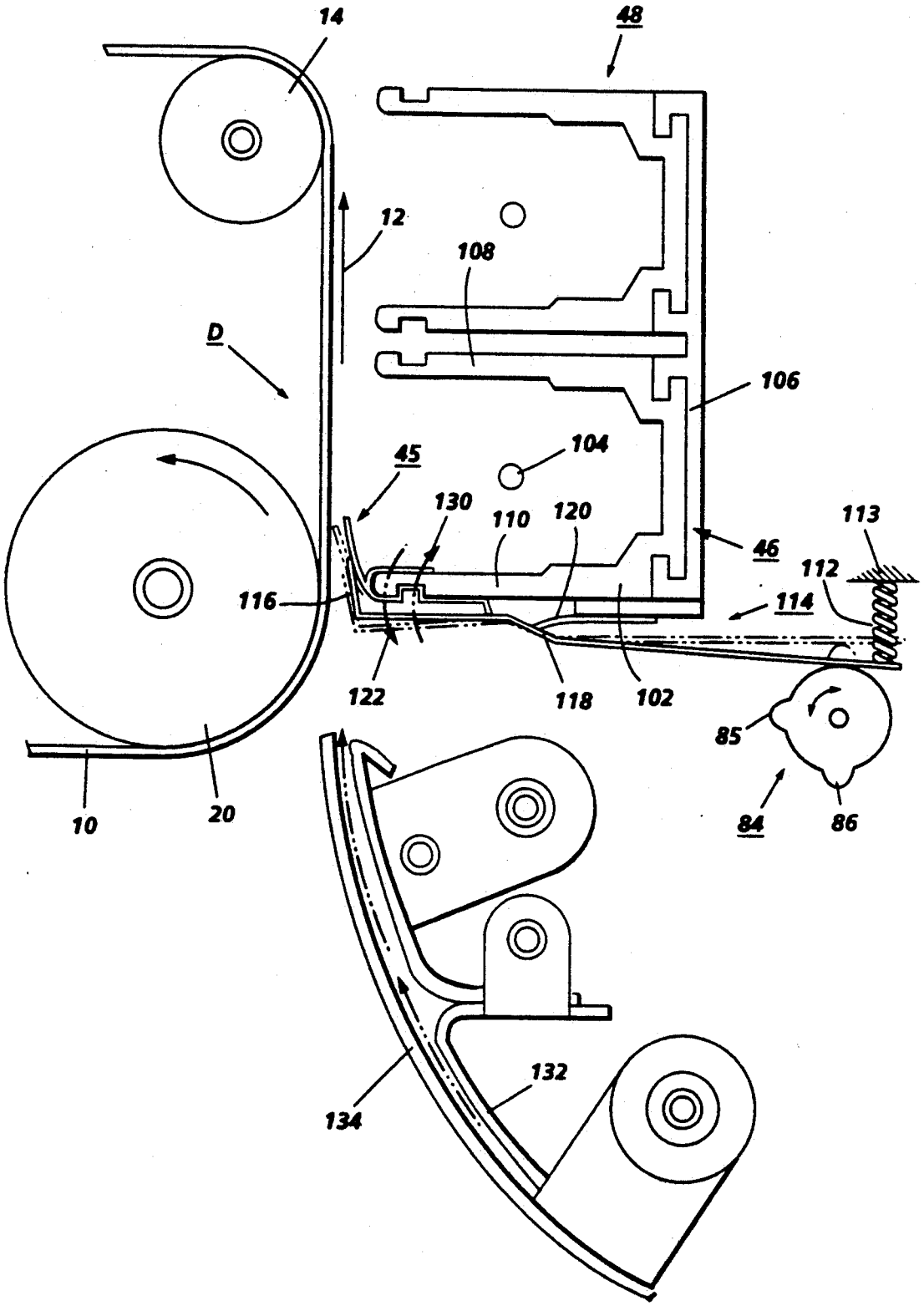
FIG. 1 is an elevational view showing the transfer assist blade and actuation mechanism of the present invention utilized for pressing the copy sheet against the developed image on the photoconductive belt in the transfer station.
Figure 2:
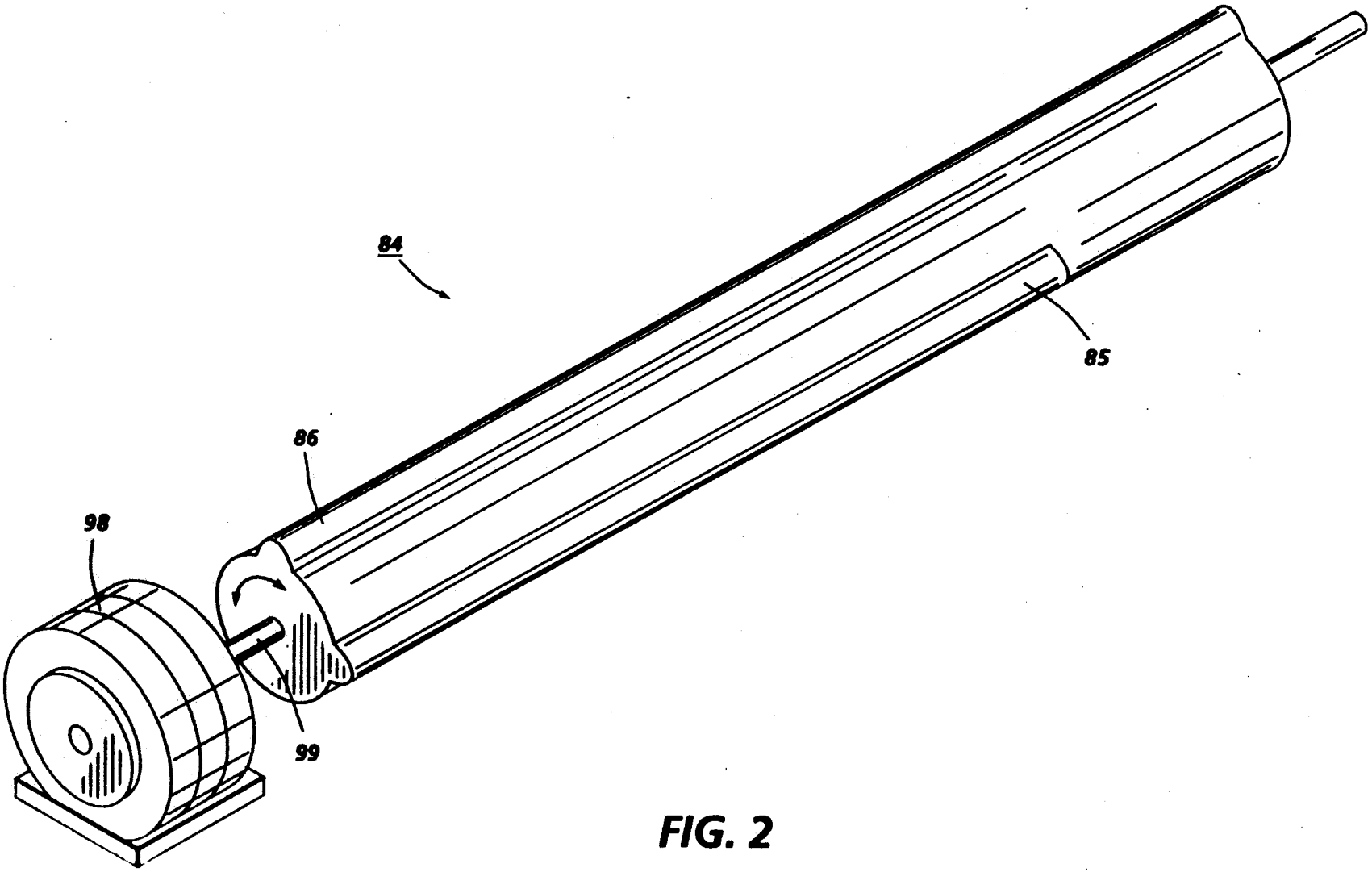
FIG. 2 is a perspective view of a rotational member used for actuation of the transfer assist blade in the embodiment of FIG. 1.

The movement of lever arm 114 is induced by rotatable member 84, also depicted in perspective view in FIG. 2. FIG. 2 depicts a rotatable shaft of the type analogous to a cam which may be appropriate for pushing against selected segments of lever arm 114 to pivot the lever arm about point 118 for shifting blade 45 between its operative and non-operative positions. The rotatable shaft of this embodiment includes independent raised segments 85 and 86 for applying pressure against arm 114 when brought into contact therewith. The shaft 84 is rotated by a motor, as for example, a stepper motor 98 coupled to the rotatable shaft 84 via a spindle 99. The stepper motor 98 applies rotational force to the rotatable shaft 84 for rotating the shaft a predetermined amount to position a selected segment of the shaft into contact with the lever arm 114. In this way, energization of stepper motor 98 causes shaft 84 to force lever arm 114 to pivot the lever arm about pivot point 118 as shown in phantom and also indicated by arrows 122 and 130. With the stepper motor energized to rotate segment 85 into contact with the lever arm 114, the lever arm pivots in a direction such that free end 116 is shifted away from blade 45, thereby allowing the blade 45 to flex from the non-operative position to the operative position against the back of a copy sheet and into contact with the photoconductive belt 10. This configuration is shown in phantom. Conversely, with segment 85 rotated such that it is not in contact with the lever arm 114, the lever arm pivots about point 118 to move free end 116 into contact with the transfer blade 45 to deflect the blade way from the belt 10 and into the non-operative position, spaced from the belt 10. A light sensor or other sensing device controls the actuation of motor 98.

Transfer blade 45 and lever arm 114 may be segmented in order to accommodate copy substrates of various dimensions. For example, it is desirable to provide an arrangement suitable for applying uniform contact pressure to standard copy substrates of at least 8½ inches by 11 inches, and 11 inches by 14 inches (among other various sizes). Thus, a rotatable shaft n in FIG. 2, may be incorporated into the present invention for providing the features thereof in an arrangement which accommodates copy substrates of various dimensions. Such an arrangement for accomodating various copy sheet sizes in a side registered xerographic machine is depicted in FIG. 3, wherein an enlarged partial cross-sectional elevated view and a plan view are shown in combination to provide perspective to the illustration. In this embodiment, a primary segment of the lever arm 114 and a corresponding primary segment of blade 45 may be driven into the operative position independent from marginal segments thereof in correspondence with the dimensional width of the copy sheet by rotating raised support surface 85, having a length corresponding to the width of the primary segment, into contact with the lever arm 114. Alternatively, both the primary segment and a marginal segment (or plural marginal segments) or lever arm 114 and corresponding segments of transfer blade 45 may also be driven to their operative position by rotating elevated support segment 86, having a dimension corresponding to a wider copy sheet, into contact with the lever arm 114. As will be understood, a plurality of marginal segments of lever arm 114 and corresponding segments of transfer blade 45 may be paired with the primary segment of the lever arm/blade combination in various configurations to provide transfer assist contact along the entire width of variously dimensioned copy sheets wherein the primary segment, and each marginal segment, is moved into the operative position by means of independent elevated support surfaces on the surface of rotational member 84, independently contacting various segments of lever arm 114. It will be further understood by one of skill in the art that a reasonable extension of this arrangement may be configured to provide a central segment along with pairs of peripheral segments corresponding to the various dimensions of copy sheets for use, as for example in a center registered xerographic machine, as shown in U.S. patent application Ser. No. 08/055,048 filed Apr. 29, 1993.

An important advantage of the present invention is derived from the fact that a rotatable member is incorporated to induce the pivotal movement of lever arm 114 for selectively positioning blade 45 in its operative and non-operative positions. A predominant deficiency has been noted in prior art systems utilizing mechanical devices that provide translational motion to provide selective positioning of the transfer assist blade, as for example, the solenoid devices disclosed in U.S. Pat. No. 4,947,214, issued to Baxendell et al., incorporated by reference herein. A commercial embodiment of the invention disclosed by that patent is presently implemented in Xerox Corporation model 5090 copying machine utilizing solenoids manufactured by Ledex, Inc. of Vandalia Ohio (model 121E4082). The response time of these solenoids is on the order of 60±20 msec for "pull in" and 45±20 msec for "push out". While the response time associated with the solenoids is sufficient to accommodate the maximum speed capabilities of the model 5090 machine at 135 copies per minute, these response times are inadequate for meeting the increased copy speed outputs contemplated in future machines. Moreover, the ±20 msec response time variation noted above represents a 30% to 50% fault tolerance, which necessitates sophisticated control algorithms and feedback configurations for limiting misfeed conditions and undesirable contact between the transfer assist blade 45 and the photoconductive surface of the belt 10. The present invention allows for the use of much faster and much more accurate stepper motor technology, as for example, the model 127E6350 stepper motor manufactured by Japan Servo Company Ltd. of Tokyo Japan, which provides 45° of rotation in less than 40 msec with placement accuracy within less than 1.8°. Thus, it will be understood that the rotational member 84 depicted in FIGS. 1 and 2 can be provided with a plurality of elevated support surfaces within 45° of a starting position, on either side thereof since the motor can rotate in both clockwise and counterclockwise directions, a shown, for example, in FIG. 4, for yielding the appropriate response times required for shifting a transfer blade between the operative and non-operative positions at speeds in a machine designed to operate at speeds of as much as 180 copies per minute, as contemplated by the present invention. One of skill in the art will recognize that an increased number of deflection surfaces may be positioned within such 45° radius to provide shifting of additional multiple lever arm segments. Further, it will be understood by one of skill in the art that an arrangement of gears might be utilized to couple stepper motor 98 to shaft 84, for providing additional speed and/or torque assistance and advantages, as may be required.

Thus, in describing the operation of the present invention, baffles 132 and 134 guide the copy sheet into the transfer station. A light sensor detects the leading edge of the copy sheet entering the transfer station and transmits a signal to processing circuitry which actuates stepper motor 98. Actuation of stepper motor 98 rotates shaft 84 to bring raised segment 85 into contact with lever arm 114, thereby applying a force thereagainst to pivot lever arm 114 in the direction of arrow 122. With the lever arm moved into this direction, free end 116 of lever arm 114 is moved away from blade 45, allowing the blade 45 to shift from a deflected, non-operative position to an undeflected, operative position where the blade 45 contacts the back of the copy sheet and presses the copy sheet against the developed toner powder image on photoconductive belt 10. The contact pressure induced by the blade 45 substantially eliminates any spaced between the copy sheet and the toner powder image to significantly improve transfer of the toner powder image to the copy sheet. Conversely, after the light sensor detects the trailing edge of the copy sheet, a signal is transmitted to processing circuitry which again actuates the stepper motor 98. Actuation of stepper motor 98 rotates shaft 84 to withdraw raised segment 85 from contact with the lever arm 114 permitting lever arm 114 to pivot in the direction of arrow 130. Thus, free end 116 is moved into contact with blade 45 to deflect the blade from the operative position to the non-operative position.

In addition to the features described above, FIGS. 4 and 5 depict an alternative embodiment of the present invention wherein rotatable member 84 is provided with a plurality of channels 115, 116 for effecting the same pivotal movement of lever arm 114. The rotatable shaft of this embodiment is positioned in an abutting relationship with a contact element 87, which is configured so as to be seated within channel 115 or 115 to allow movement of transfer blade 45 from the operative to non-operative position. The configuration presented by this embodiment allows for even more highly accurate placement of the rotational member in alignment with a predetermined segment of the rotational member in the situation wherein a plurality of depressions may be provided over a relatively small segment of the circumference of shaft 84 to accommodate various sheet dimensions, as described herein.

In review, the transfer apparatus of the present invention includes a blade member, normally spaced from the photoconductive surface, in the non-operative position, which moves to an operative position pressing the copy sheet into intimate contact with the toner powder image developed on the photoconductive belt. This insures that the copy sheet is placed in intimate contact with the toner powder image on the photoconductive surface. A corona generating device generates a transfer field effective to transfer the toner powder image from the photoconductive belt to the copy sheet without deletions. It will be appreciated that the transfer assist blade disclosed herein may include multiple segments which may be selectively moved to provide contact across the various widths of standard size copy sheets in a xerographic printing machine. Moreover, the combination of such a segmented transfer assist blade with the cam 84, permits uniform contact across various sheet dimensions while preventing contact between marginal segments of the transfer assist blade and the photoreceptor which may cause damage to the photoreceptor or contamination of the transfer assist blade.

It is, therefore, evident that there has been provided, in accordance with the present invention, an apparatus that fully satisfies the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for providing substantially uniform contact between a copy sheet and a developed image situated on an imaging surface, comprising:

contact means including a flexible blade member, adapted to be shifted from a non-operative position spaced from the imaging surface, to an operative position in contact with the copy sheet on the imaging surface, for pressing the copy sheet against the imaging surface;

a lever member, pivotable about a pivot point, for shifting said contact means between the non-operative position and the operative position; and rotatable means for selectively pivoting said lever member about said pivot point to effect the shifting of said contact means between the non-operative position and the operative position.

2. The apparatus of claim 1, further including biasing means for urging said lever member into an abutting relationship with said contact means to deflect said contact means into the non-operative position.

3. The apparatus of claim 2, wherein said rotatable means includes an elevated support surface for applying a load against said lever arm to pivot said lever arm about said pivot point.

4. The apparatus of claim 2, wherein:

said lever member includes an elevated contact ridge; and said rotatable means includes a channel for receiving said elevated contact point to permit the pivotal movement of said lever arm about said pivot point.

5. The apparatus of claim 1, further including a stepper motor coupled to said rotatable member for selectively rotating said rotatable member to a predetermined angular position.

6. The apparatus of claim 5, wherein said motor is adapted to rotate said rotatable member for shifting said contact means into the operative position in response to detection of a leading edge of the copy sheet contacting the developed image on the imaging surface.

7. The apparatus of claim 6, wherein said motor is further adapted to rotate said rotatable member for shifting said contact means into said non-operative position in response to detection of a trailing edge of said copy sheet passing under said contact means.

8. The apparatus of claim 5, wherein said motor has a response time of less than 40 milliseconds for rotating said rotatable member to effect the shifting of said contact means between said operative and non-operative positions.

9. The apparatus of claim 1, wherein:

said contact means includes a plurality of blade segments such that selected blade segments have a cumulative widthwise dimension corresponding to a widthwise dimension of the copy sheet;

said lever member includes a plurality of segments corresponding in width to each of said blade segments; and said rotatable means includes a means for selectively pivoting predetermined segments of said lever member to effect the shifting of selected blade segments between the nonoperative position and the operative position.

10. An electrostatographic printing machine including a transfer station for transferring a developed image from a moving imaging member to a moving copy substrate, including an apparatus for providing substantially uniform intimate contact between the copy substrate and the developed image located on the imaging member, comprising:

contact means including a flexible blade member, adapted to be shifted from a non-operative position spaced from the imaging surface, to an operative position in contact with the copy substrate on the imaging member, for pressing the copy substrate against the imaging member;

a lever member, pivotable about a pivot point, for shifting said contact means between the non-operative position and the operative position; and rotatable means for selectively pivoting said lever member about said pivot point to effect the shifting of said contact means between the non-operative position and the operative position.

11. The electrostatographic printing machine of claim 10, further including biasing means for urging said lever member into an abutting relationship with said contact means to deflect said contact means into the non-operative position.

12. The electrostatographic printing machine of claim 11, wherein said rotatable means includes an elevated support surface for applying a load against said lever arm to pivot said lever arm about said pivot point.

13. The electrostatographic printing machine of claim 11, wherein:

said lever member includes an elevated contact ridge; and said rotatable means includes a channel for receiving said elevated contact point to permit the pivotal movement of said lever arm about said pivot point.

14. The electrostatographic printing machine of claim 10, further including a stepper motor coupled to said rotatable member for selectively rotating said rotatable member to a predetermined angular position.

15. The electrostatographic printing machine of claim 14, wherein said motor is adapted to rotate said rotatable member for shifting said contact means into the operative position in response to detection of a leading edge of the copy sheet contacting the developed image on the imaging member.

16. The electrostatographic printing machine of claim 15, wherein said motor is further adapted to rotate said rotatable member for shifting said contact means into said non-operative position in response to detection of a trailing edge of said copy substrate passing under said contact means.

17. The electrostatographic printing machine of claim 14, wherein said motor has a response time of less than 40 milliseconds for rotating said rotatable member to effect the shifting of said contact means between said operative and non-operative positions.

18. The electrostatographic printing machine of claim 10, wherein:

said contact means includes a plurality of blade segments such that selected blade segments have a cumulative widthwise dimension corresponding to a widthwise dimension of the copy sheet;

said lever member includes a plurality of segments corresponding in width to each of said blade segments; and said rotatable means includes a means for selectively pivoting predetermined segments of said lever member to effect the shifting of selected blade segments between the nonoperative position and the operative position.

19. An apparatus for providing substantially uniform contact between a copy sheet and a developed image situated on an imaging surface, comprising:

contact means, adapted to be shifted from a non-operative position spaced from the imaging surface, to an operative position in contact with the copy sheet on the imaging surface, for pressing the copy sheet against the imaging surface;

means for selectively shifting said contact means between the non-operative position and the operative position in a time period no greater than 40 milliseconds.

20. An electrostatographic printing machine including a transfer station for transferring a developed image from a moving imaging member to a moving copy substrate, including an apparatus for providing substantially uniform intimate contact between the copy substrate and the developed image located on the imaging member, comprising:

contact means, adapted to be shifted from a non-operative position spaced from the imaging surface, to an operative position in contact with the copy substrate on the imaging member, for pressing the copy substrate against the imaging member;

means for selectively shifting said contact means between the non-operative position and the operative position in a time period no greater than 40 milliseconds.

* * * * *